US006517443B1

(12) United States Patent
Villella

(10) Patent No.: US 6,517,443 B1
(45) Date of Patent: Feb. 11, 2003

(54) WHEELCHAIR ACCESSIBLE AMUSEMENT RIDE

(75) Inventor: Larry A. Villella, Fargo, ND (US)

(73) Assignee: Access Kiddie Rides, Inc., Fargo, ND (US)

( * ) Notice: Subject to any disclaimer, the term of this patent is extended or adjusted under 35 U.S.C. 154(b) by 0 days.

(21) Appl. No.: 09/883,597

(22) Filed: Jun. 18, 2001

(51) Int. Cl.[7] ..... A63G 13/06

(52) U.S. Cl. ..... 472/95; 472/100; 472/96; 414/921

(58) Field of Search ..... 472/95, 96, 100, 472/101, 43; 414/921; 296/65.01, 68, 65.03, 65.04; 104/53

(56) References Cited

U.S. PATENT DOCUMENTS

| | | | | | |
|---|---|---|---|---|---|
| 2,710,659 | A | | 6/1955 | Moederle | 180/11 |
| 3,167,350 | A | | 1/1965 | Kiel | 297/267 |
| 3,415,531 | A | | 12/1968 | Kiel | 280/30 |
| 4,641,848 | A | | 2/1987 | Ayers | 280/242 |
| 4,671,730 | A | * | 6/1987 | Gateau | 414/495 |
| 4,865,312 | A | | 9/1989 | Katz | 272/56.5 |
| 5,094,314 | A | | 3/1992 | Hayata | 180/217 |
| 5,376,053 | A | | 12/1994 | Ponder et al. | 472/119 |
| 5,531,645 | A | * | 7/1996 | Collins | 396/1 |
| 5,730,236 | A | | 3/1998 | Miller et al. | 180/65.1 |
| 5,785,340 | A | | 7/1998 | Dias | 280/304.1 |
| 5,829,201 | A | | 11/1998 | Schelter et al. | 52/9 |
| 5,884,563 | A | * | 3/1999 | Sheldon et al. | 104/53 |
| 5,935,011 | A | | 8/1999 | Morgan et al. | 472/29 |
| 5,938,283 | A | | 8/1999 | Babock et al. | 297/273 |
| 5,993,216 | A | | 11/1999 | Stogner | 434/29 |
| 6,024,369 | A | | 2/2000 | Goldstein et al. | 280/248 |
| 6,032,972 | A | | 3/2000 | Dias | 280/304.1 |
| 6,074,306 | A | | 6/2000 | Behringer | 472/43 |
| 6,149,528 | A | | 11/2000 | Volz et al. | 472/43 |
| 6,171,198 | B1 | * | 1/2001 | Lizama Troncoso et al. | 472/29 |

* cited by examiner

*Primary Examiner*—Kien T. Nguyen
(74) *Attorney, Agent, or Firm*—Curtis Harr

(57) ABSTRACT

A wheelchair accessible amusement ride having a solid non-moving base to which a body that rocks back and forth on the base is mounted. The interior of the body is supplied with a seat that may move between a first position for use with able bodied children who may sit in the seat and operate the controls of the ride and a second forward stowed position allowing the interior compartment to give access to a wheelchair and wheelchair bound individual. The seat is mounted to a series of rails allowing the seat to easily be moved and locked between the two positions. The device is further equipped with a rear gate that may be dropped and used as a ramp to load a wheelchair and wheelchair bound individual into the device prior to closing the gate and containing the wheelchair and handicapped individual for the ride, thus allowing wheelchair bound children the same chance to have experience with these rides as able bodies children and adults.

19 Claims, 9 Drawing Sheets

FIG 1
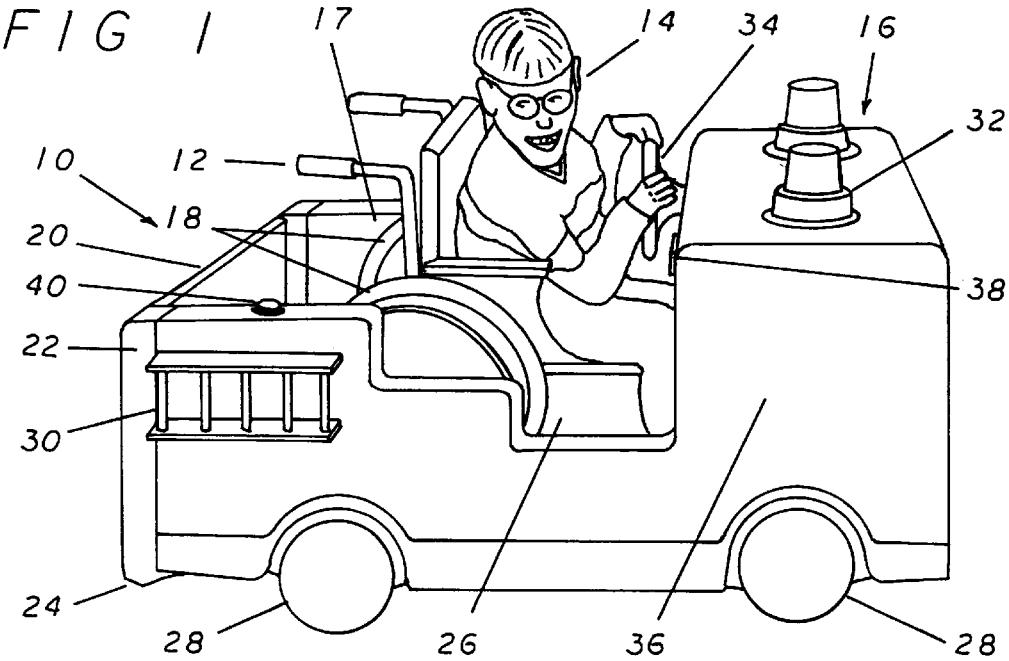
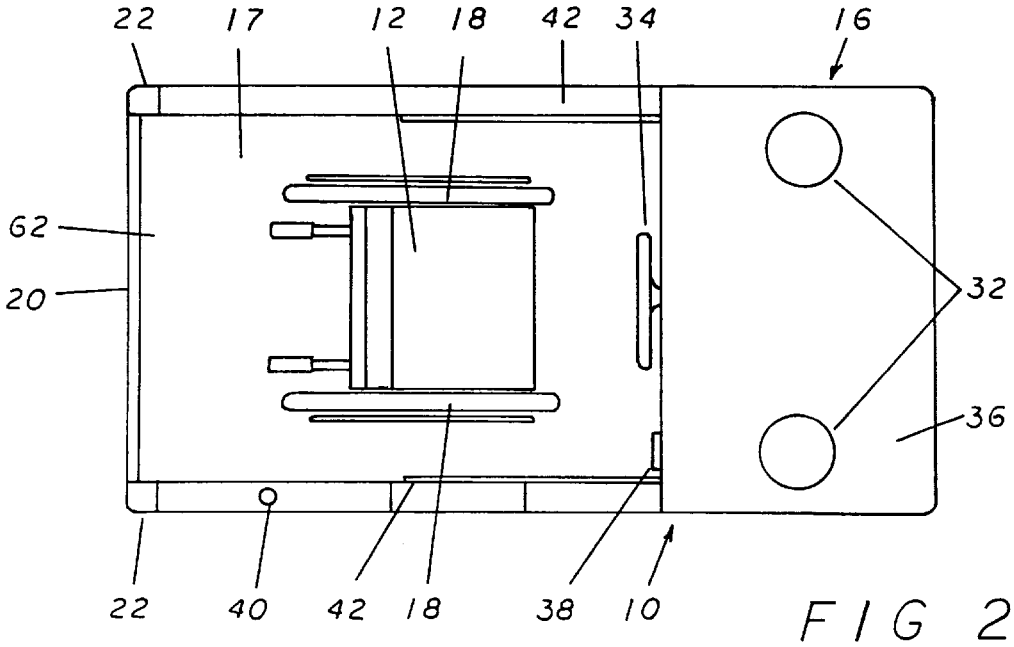
FIG 2

FIG 3
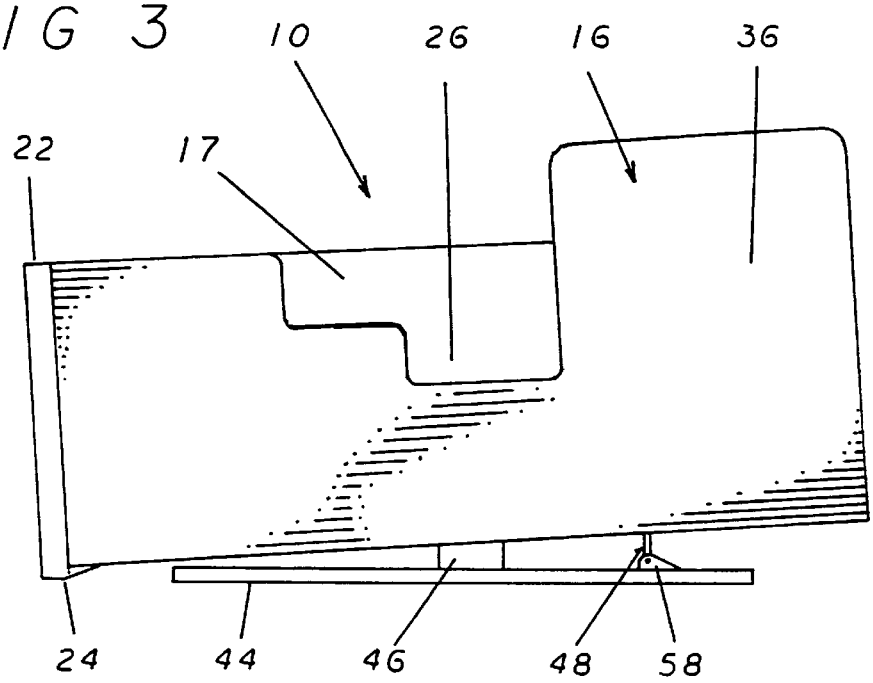
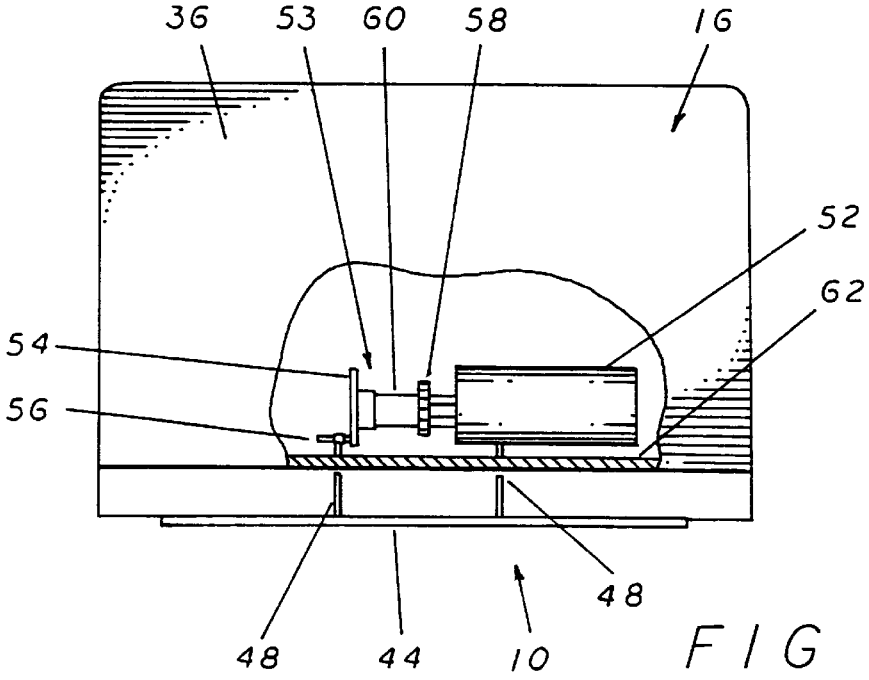
FIG 4

FIG 5
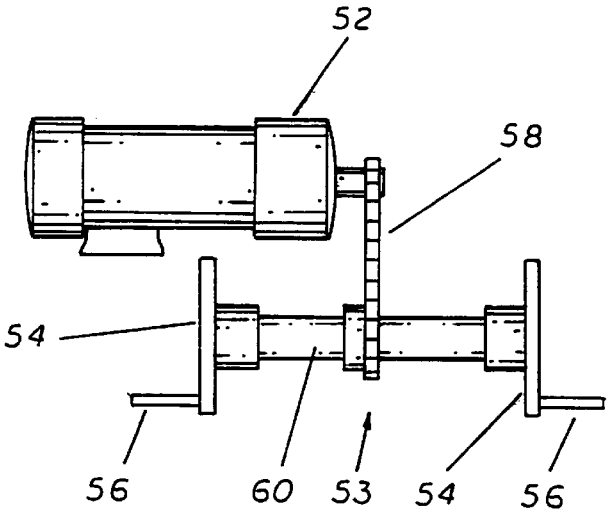
FIG 6
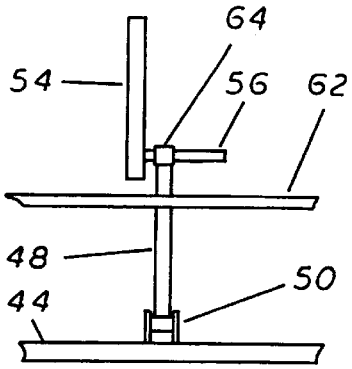
FIG 7
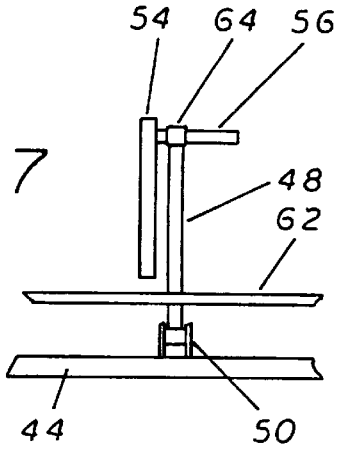
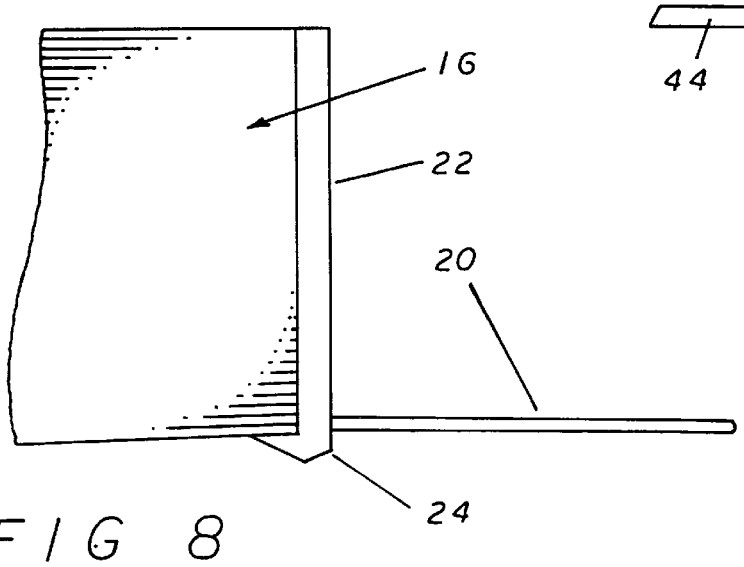
FIG 8

FIG 9
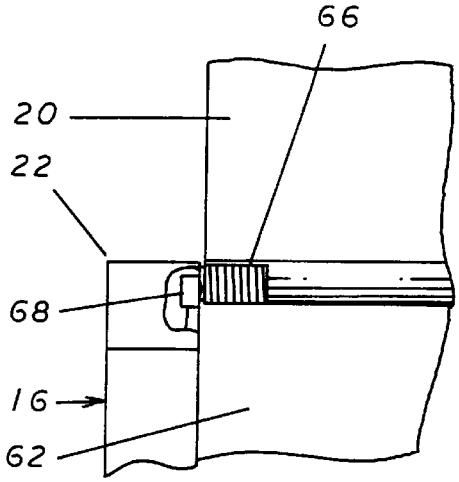
FIG 10
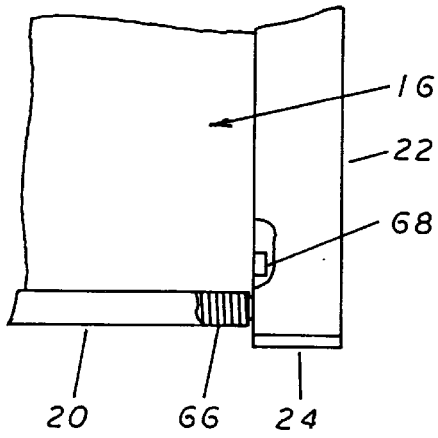
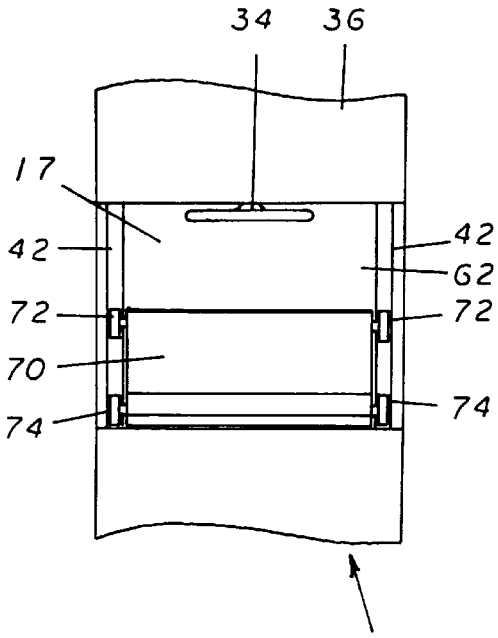
FIG 11
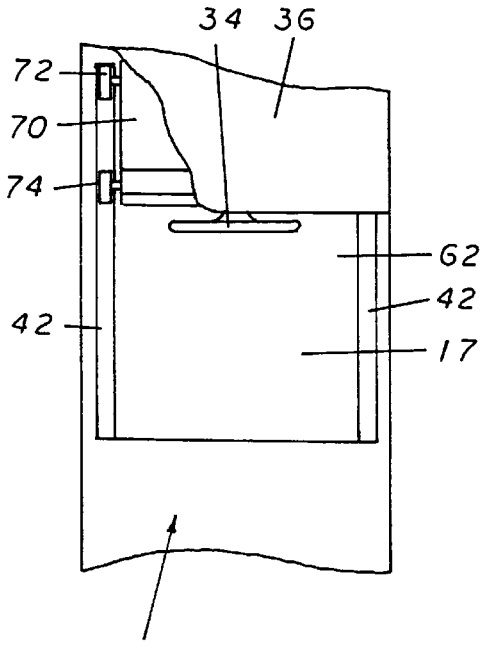
FIG 12

FIG 13
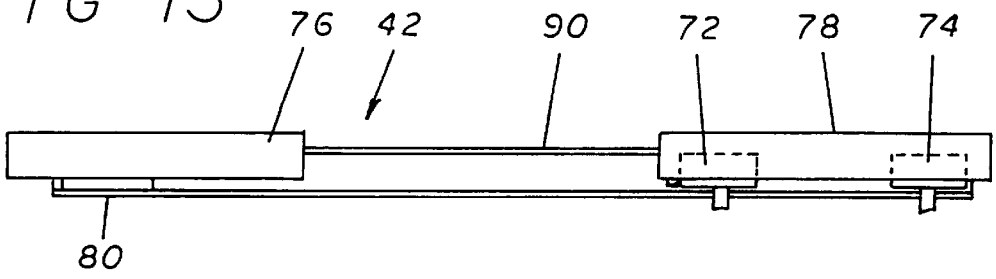
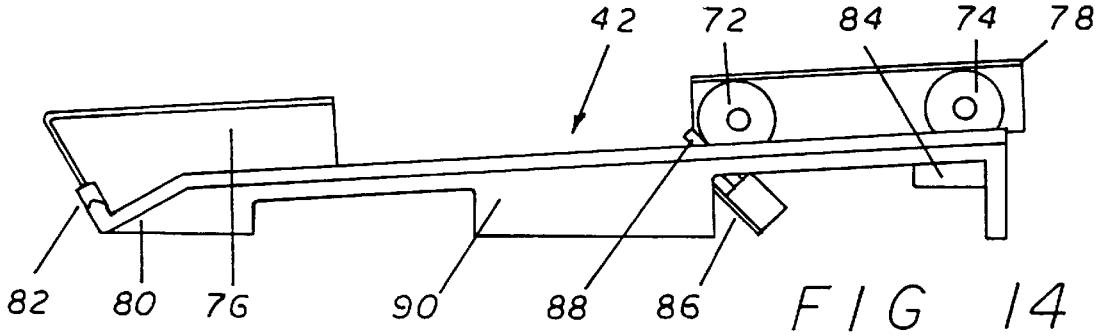
FIG 14
FIG 15
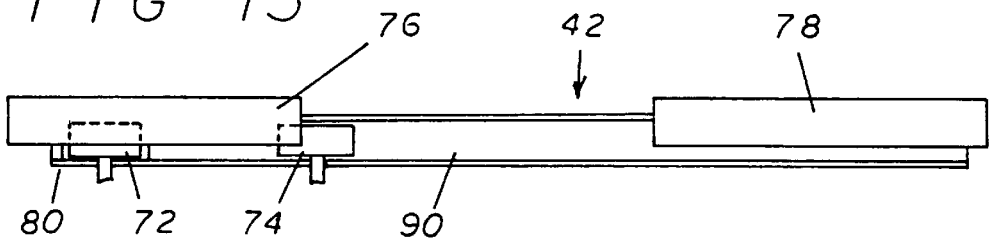
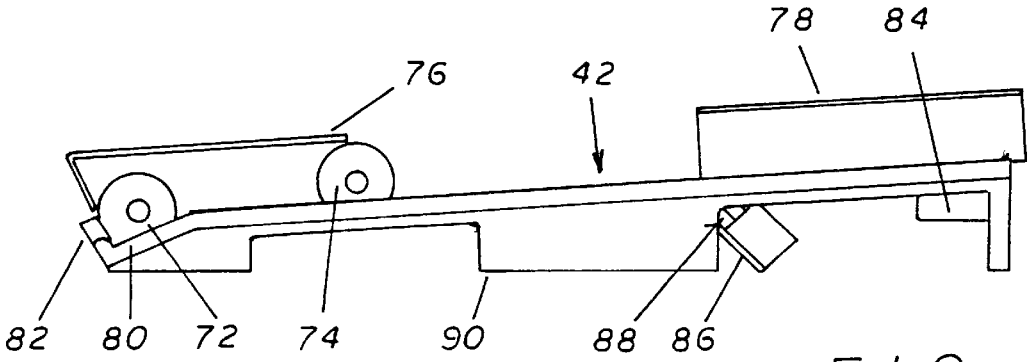
FIG 16

FIG 18
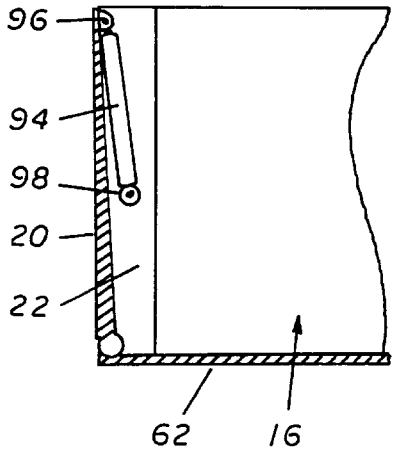
FIG 19
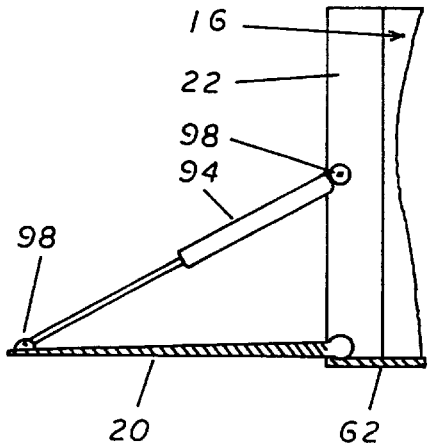
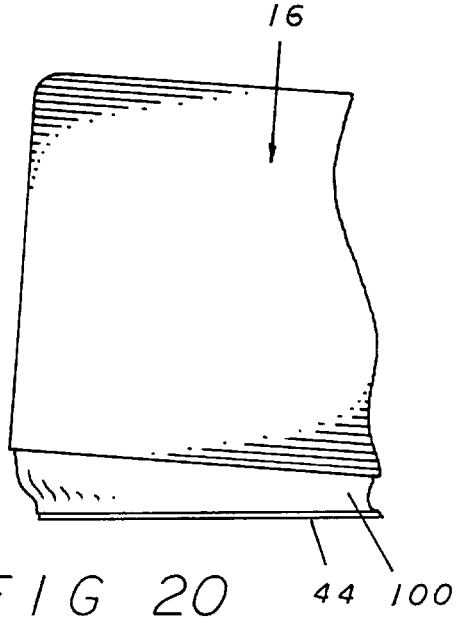
FIG 20
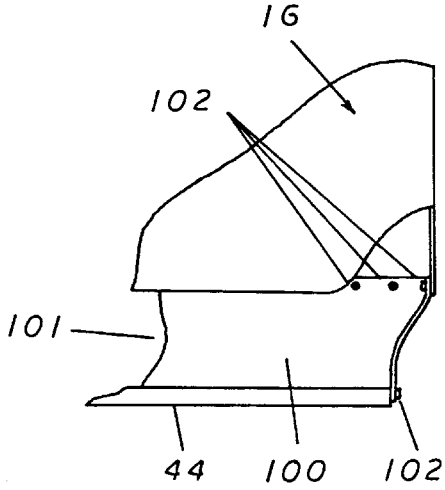
FIG 21

FIG 22
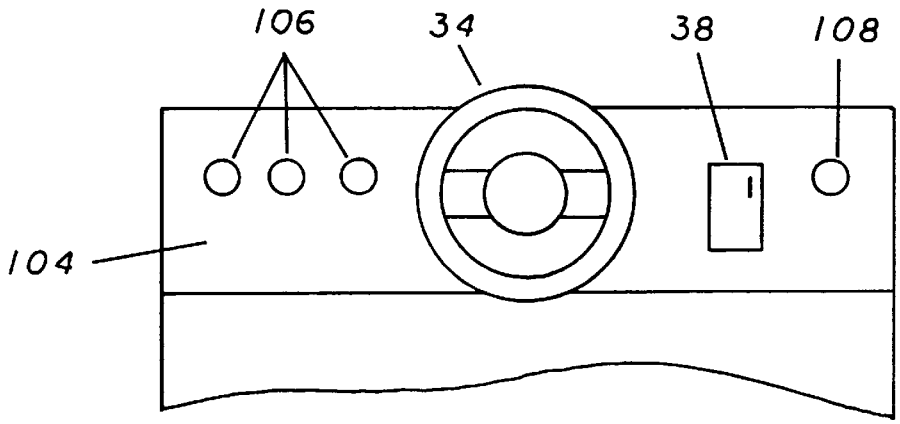
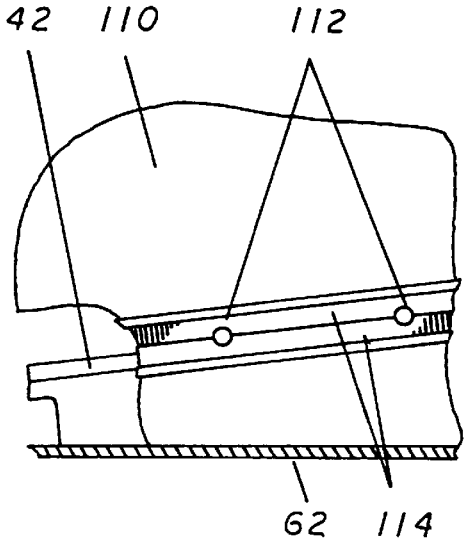
FIG 23
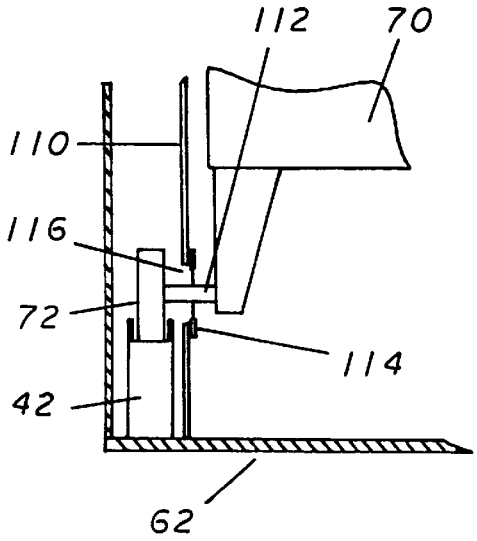
FIG 24

FIG 25
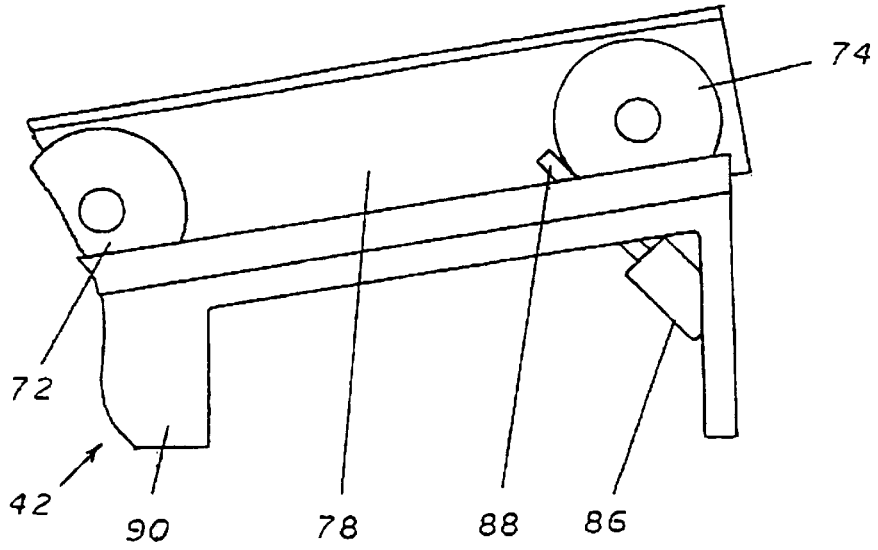
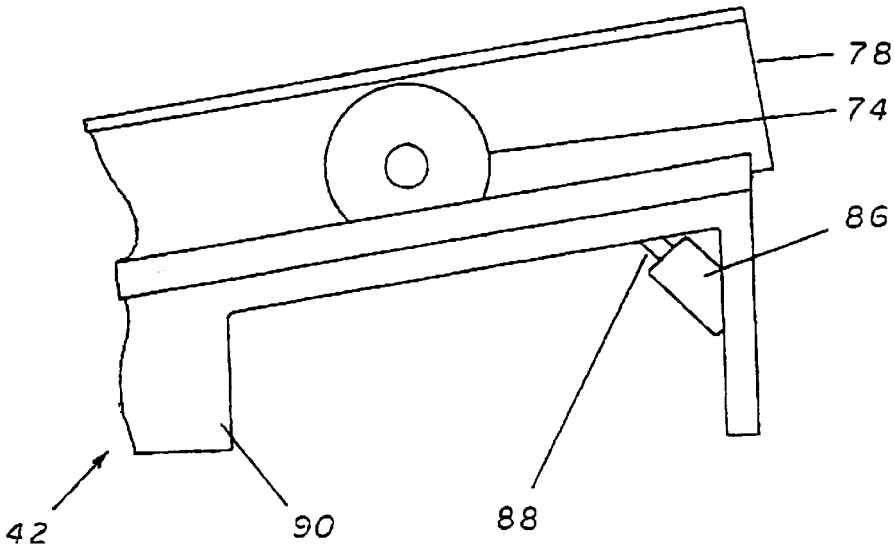
FIG 26

WHEELCHAIR ACCESSIBLE AMUSEMENT RIDE

BACKGROUND OF THE INVENTION

The field of this invention in general is powered amusement rides for children and, more specifically, an amusement ride which may easily be configured to give access to wheelchairs so that physically handicapped people may enjoy the ride while also allowing for able bodied individuals to similarly enjoy the ride.

Amusement or kiddie rides have become increasingly popular and are commonly used outside of grocery stores, department stores, amusement parks and restaurants for the enjoyment of small children and parents watching and assisting their children in using the rides. Typical kiddie rides consist of a horse, a rocket, a car or other similar device mounted to a solid non-moving base. The user inserts a coin to allow the ride to move generally in a back and forth or rocking type motion for a given amount of time. These rides have long been known and used by small children over the years. However, most of these rides, as they are sit on such as horses, rockets or small climb-in type of rides such as cars, are not accessible to handicapped children and especially handicapped children bound to wheelchairs.

Recently it has been known to modify large moving amusement park rides to allow for wheelchair access. One type of ride is shown by the Volz et al. U.S. Pat. No. 6,149,528 patent assigned to Universal City Studio, Inc. This patent generally discloses a ride where the seats for able bodied users fold out of the way through a complex mechanism allowing a wheelchair to be wheeled into place and locked down to the ride. However, this does not solve the problem of making small generally base mounted kiddie rides such as those used at department stores and grocery stores accessible to individuals in wheelchairs.

From this discussion, it can be seen that it would be desirable to make a small base mounted type ride as are commonly used outside of grocery stores and department stores accessible to wheelchair bound individuals while also allowing the ride to be used by able bodied individuals, thus increasing the number of people that may use the ride while allowing wheelchair bound children access to rides and experiences previously limited to able bodies children.

SUMMARY OF THE INVENTION:

It is the primary objective of the present invention to provide a means by which handicapped individuals who are bound to wheelchairs, especially children, can gain access to the rocker type amusement rides that are commonly found in amusement parks and around the entrances of department stores and other high traffic public areas.

It is an additional objective of the present invention to provide such a means of allowing access to such amusement rides that will not requirewheelchair bound individuals to leave their wheelchair in order to enjoy the entertainment provided by such amusement rides.

It is a further objective of the present invention to provide such a means of allowing access to such amusement rides to handicapped individuals that will enable them to position their wheelchair within the interior of the ride without the aid of others.

It is a still further objective of the present invention to provide such a means of allowing access to these amusement rides to wheelchair bound individuals in a manner that will also enable non-handicapped individuals to enjoy the ride when it is not otherwise engaged.

These objectives are accomplished by the use of a rocker type amusement ride that is built in such a manner as to allow for the placement of a wheelchair within its body. With this in mind, the present invention is generally fashioned in the shape of a fire truck, or other relatively large bodied vehicle such as automobiles, stage coaches, boats, or trucks, and which contains a centrally located cavity large enough to accept a wheelchair and its occupant. This configuration allows a person that is confined to a wheelchair that can normally not enjoy the entertainment offered by these types of amusement rides to easily enter the present invention and operate the device from the confines of their wheelchair.

The entrance to the invention by the wheelchair occupant is accomplished through a drop gate located at the rear of the body of the invention. The drop gate is pivotally attached to the body of the invention on either side of its lower surface which allows it to be swung in a downward manner when the upper latch is released. In this downward position, the drop gate effectively forms an access ramp which allows for wheelchair access into the interior of the present invention. Additionally, the drop gate is also equipped with a plurality of. shock absorbers which limit the speed at which the end gate will open eliminating the danger that may be associated with the gate striking a person in the opening process.

Additionally, the interior of the invention is equipped with a moveable seat which in its rearward position provides a seat for able-bodied users that positions them in front of the mock steering wheel or console. For use by disabled patrons, the moveable seat can be slid forward on a system of wheels and rails into the forward cavity of the invention's body where it is out of the way and allows a wheelchair occupant access to the forward portion of the body cavity where they can manipulate the steering wheel and obtain the full entertainment value of the operation of the present invention. The rails and moveable seat wheels in this configuration are also positioned behind inner side panels which ensure that an individual using the invention is not exposed to the moving parts contained in these areas and is therefore, isolated from the potential risk of injury that normally accompanies similar moving components.

The general operations of the present invention are controlled through the power supply positioned in the interior of the body and which can be activated and controlled through a coin operated or keyed mechanism and which controls two interconnected electrical circuits. The first of these operates the electric motor and rocking system which is located in the forward cavity of the body of the invention. The activation of this circuit starts the electric motor turning which rotates a pair of cams. These cams are connected to rods which are in turn connected to the base of the invention. The rotation of the cams causes the forward portion of the invention to raise and lower in relation to the base which, due to the pivotal nature of the body's attachment to the base, causes the entire body to rock in an gentle up and down manner.

The second circuit controlled by the power supply is a series of positional switches and solenoids which are in turn connected to the solenoid control switch. This system both monitors the position of the moveable seat and end gate and controls the position of the moveable seat through the wheel solenoid. The monitoring function works to ensure that both the end gate and moveable seat are in the proper position before the electric motor can be engaged. That is to say, if the end gate is not in the upright and locked position, the electric motor is prevented from operation by the power supply. Similarly, if the moveable seat is not either fully forward for use with wheelchair bound individuals or fully rearward for use with able-bodied individuals, the electric motor is also prevented from operating by this circuit.

The positional function of this circuit is operated through the wheel solenoid which operates in normal circumstances to lock the moveable seat into the full rearward position. This function is performed by the solenoid's protrusion into the track area just in front of the front wheel of the moveable seat. Due to the fact that the rail is slanted from a high point at its rear a low point at its front, this positioning of the solenoid holds the moveable seat in a rearward position when it is fully extended. Conversely, when the solenoid is retracted, the moveable seat is allowed to roll forward to its stored position in the forward cavity of the invention's body, allowing a wheelchair bound individual access to the ride.

An additional embodiment of the moveable seat wheel track is also provided which positions the solenoid in front of the rear seat wheel instead of in front of the front wheel. This positioning of the solenoid simplifies the operations and manufacture of the invention which will be more fully explained below. In terms of the operation of the moveable seat, the change of location of the solenoid does not alter the manner in which the seat is moved from its rearward to its forward positions or from its forward to its rearward positions.

Therefore, when a wheelchair bound individual approaches the invention the moveable seat is held in its rearward position and the end gate is up and closed. In this position, the invention is capable of operation by an able-bodied individual as the rearward wheel switch is properly activated by the position of the moveable seat and the gate switch is properly activated by the position of the end gate. The wheelchair bound individual converts the invention to wheelchair accessible by first opening the rear gate and then depressing the solenoid control switch which retracts the solenoid plunger and releases the moveable seat which then rolls forward into the forward cavity of the invention's body. In this position, the forward wheel of the moveable seat activates the forward wheel switch and the wheelchair bound individual can then position the wheelchair within the body cavity. The end gate is then closed which activates the gate switch and allows for the activation of the electric motor and provides the rocking motion desired by the wheelchair bound individual.

Additionally, the end gate assembly also contains a warning beeper that is connected through the end gate position sensor and which is activated at all times when the end gate is in the open position. This safety feature functions much like the backup warning bells connected to most large trucks which are engaged when the vehicle is in reverse and warn people in the vicinity of the rearward motion of the truck. In the case of the present invention, the warning buzzer alerts nearby people of an open gate limiting the chances that they may trip over it and injure themselves.

Finally, the present invention is also equipped with a safety feature which ensures no one can be injured by having a body part pinched between the invention's body and its base during the rocking process. This component consists of a flexible skirt which spans the gap between the lowest most edge of the body and the base around the entirety of the invention. The use of the skirt ensures that nothing can be placed between the body and the base which ensures that no human appendages can be injured during the invention's operation.

For a better understanding of the present invention reference should be made to the drawings and the description in which there are illustrated and described preferred embodiments of the present invention.

DESCRIPTION OF THE DRAWINGS

FIG. 1 is a perspective view of the present invention which illustrates the manner in which a wheelchair bound individual can be positioned within the body of the present invention thereby allowing them to enjoy the entertainment provided by such amusement rides to which they are normally incapable of gaining access.

FIG. 2 is a top elevation view of the present invention illustrating the relative position of a wheelchair within the body cavity of the invention in relation to the other major components.

FIG. 3 is a side elevation view of the present invention illustrating the position and configuration of the rocking base in relation to the body and the pivotal nature of the attachment of the two which allows the body to produce the rocking motion that is central to the operation of the ride.

FIG. 4 is a front elevation cut-away view of the present invention illustrating the position of the electric motor and rocker assembly within the forward cavity of the body of the invention and further detailing the configuration of the rocker base.

FIG. 5 is a top elevation view of the electric motor and rocker assembly detailing their general configuration and the positions of the rotation cams and the cam drive chain in relation to the drive motor.

FIG. 6 is a front elevation view of the rotation cam and cam rod components of the present invention detailing their position and the positions of the body floor and base when the cam has been fully rotated into the down position which widens the gap between the body floor and base and initiates the rocking motion of the amusement ride.

FIG. 7 is a front elevation view of the rotation cam and cam rod components of the present invention detailing their position and the positions of the body floor and base when the cam has been fully rotated into the up position which closes the gap between the body floor and base and completes the rocking motion of the amusement ride.

FIG. 8 is side elevation view of a the rear portion of the body of the invention detailing the position of the end gate when it is in the lowered position and the manner in which it forms a ramp that provides access to the interior of the invention to a wheelchair bound individual.

FIG. 9 is a top elevation cut-away view of the end gate component of the present invention detailing the position of the gate spring and the gate switch when the end gate is in the down position.

FIG. 10 is a rear elevation cut-away view of the end gate component of the present invention detailing the position of the gate spring and the gate switch when the end gate is in the down position.

FIG. 11 is a top elevation view of the body cavity portion of the present invention illustrating the position of the moveable seat and seat rails when the seat is in the rearward position for use with able-bodied individuals.

FIG. 12 is a top elevation cut-away view of the body cavity portion of the present invention illustrating the position of the moveable seat when it is in the forward position for use with a wheelchair bound individual.

FIG. 13 is a top elevation view of the seat guide rail components of the present invention detailing their manner of construction and the position of the seat wheels when the moveable seat is in the rearward position.

FIG. 14 is a side elevation view of the seat guide rail components of the present invention detailing the positions of the forward wheel switch, rearward wheel switch, and the wheel solenoid and associated solenoid plunger when the moveable seat is in the rearward position.

FIG. 15 is a top elevation view of the seat guide rail components of the present invention detailing their manner of construction and the position of the seat wheels when the moveable seat is in the forward position.

FIG. 16 is a side elevation view of the seat guide rail components of the present invention detailing the positions of the forward wheel switch, rearward wheel switch, and the wheel solenoid and associated solenoid plunger when the moveable seat is in the forward position.

FIG. 18 is a side elevation cross-sectional view of the end gate component of the present invention illustrating the manner in which the shock assembly is attached to the invention between the end gate and the gate frame located at the most rearward end of the ride body.

FIG. 19 is a side elevation cross-sectional view of the end gate component of the present invention illustrating the manner in which the shock assembly spans the opening gap between the end gate and the gate frame as the end gate is lowered into its open ramp position.

FIG. 20 is a side elevation view of the present invention illustrating the use of its body skirt component which is a safety feature of the invention which ensures that body parts or other obstacles can become pinched between the body and the base during the rocking action of normal operation.

FIG. 21 is a side elevation cut-away view of the body skirt component of the present invention detailing the general configuration of the skirt and the manner employed to attach it to the correct portion of the invention.

FIG. 22 is a front elevation view of the dashboard component of the present invention illustrating the position of the start switch and accessory switches in relation to the steering wheel and power supply.

FIG. 23 is a side elevation cut-away view of the inner side panel components of the present invention illustrating the manner in which the moving parts of the moveable seat are isolated from the invention's user.

FIG. 24 is a front elevation cut-away view of the inner side panel component of the present invention detailing the method used to seal the wheel axles as they pass through the inner panel walls.

FIG. 25 is a side elevation view of an alternative embodiment of the seat guide rail component of the present invention which positions the wheel solenoid in front of the rear seat wheel instead of in front of the front seat wheel to hold the seat in the rearward position used by able bodied individuals.

FIG. 26 is a side elevation view of an alternative embodiment of the seat guide rail component of the present invention illustrating the manner in which the rear wheel of the moveable seat moves forward along the seat guide rail when the plunger of the wheel solenoid is retracted to allow the moveable seat to move forward into the position which allows wheel chair bound individual access to the body cavity of the present invention.

DESCRIPTION OF THE PREFERRED EMBODIMENT

Figure 17:
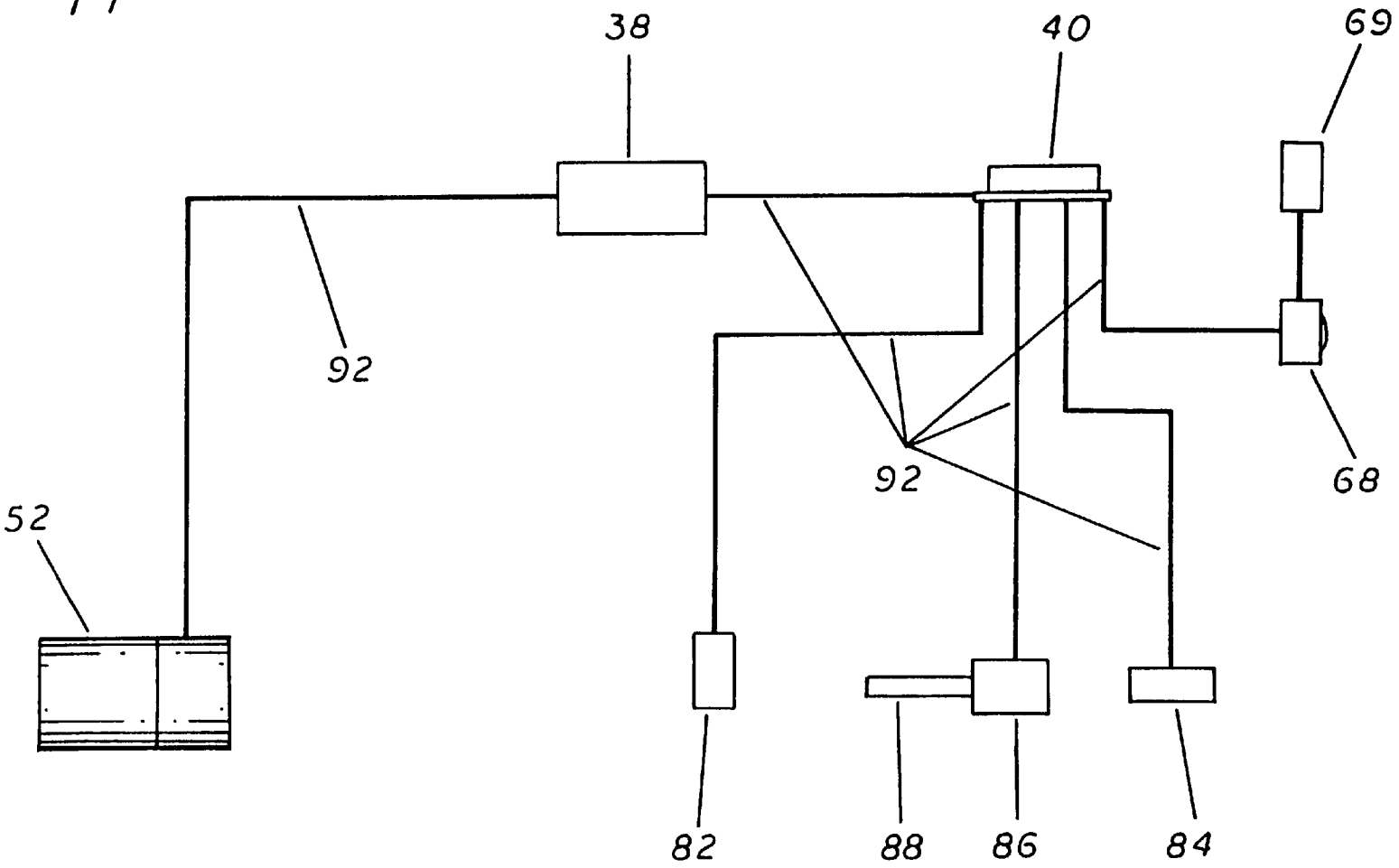
FIG. 17 is a flow chart representation of the electrical systems of the present invention illustrating the manner in which the circuits and their related components are interconnected through the power supply.

Referring now to the drawings, and more specifically to FIGS. 1 and 2, the wheelchair accessible amusement ride 10 is an adaptation of the rocking type amusement rides that are commonly found in public areas. The present invention is made up of a ride body 16 that is typically a formed fiberglass shell containing a centrally located body cavity 17 and a large flat and stable body floor 62 and which is generally shaped to resemble a fire engine or other similar larger vehicle or child friendly shape. The ride body 16 is designed with the large and accessible body cavity 17 and the body floor 62 to enable it to house a wheelchair 12 and the wheel chair occupant 14 during the operation of a rocking type amusement ride.

As previously stated, the ride body 16 of the present invention is formed in a manner so that it readily resembles a child friendly shape such as a fire truck (as illustrated in FIGS. 1 and 2) which is accomplished by the general shape and color of the ride body 16 accompanied by aesthetic additions such as body wheels 28, fire ladders 30, steering wheels 34, and rotating emergency lights 32. The use of these details adds to the overall enjoyment of the present invention as the most common users of such devices are children who view these additions as essential to the creation of a sense of realism to the amusement ride experience. Similar details may be added to other shapes as necessary.

Access for the wheelchair 12 and wheelchair occupant 14 to the body cavity 17 is gained through the end gate/ramp 20 located on the most rearward end of the ride body 16. The end gate/ramp 20 is pivotally attached to the ride body 16 at the inner and lower surfaces of the two gate frames 22 which are essentially metallic end caps that provide for the pivotal mounting of the end gate/ramp 20. Without the use of the metallic gate frames 22 the pivotal attachment of the end gate/ramp 20 would place too much stress on a mounting to bare fiberglass to be practically operational.

Additionally, the lower ends of the gate frames 22 also have an angled foot 24 which serve to provide a stable contact point with the surface upon which the invention is placed when the end gate/ramp 20 is open and swung down (as detailed in FIG. 8) to form a ramp over which the wheelchair occupant 14 can maneuver his wheelchair wheels 18 to gain access to the body cavity 17 of the present invention. Once access to the body cavity 17 has been gained and the wheelchair 12 has been properly positioned, the end gate/ramp 20 is closed and securely latched to ensure that the wheelchair occupant 14 is provided the greatest degree of safety as possible.

The ride body 16 also provides the mounting point for the power supply 38 and the solenoid control switch 40. The power supply 38 is the component of the present invention which is used to control the actual mechanical and electrical functions associated with the operation of the these types of amusement rides and is generally positioned in an accessible position of the ride body 16 on the outer surface of the forward body cavity 36. The operation of the power supply 38 is typically controlled by the use of a common coin activated device which allows a user to operate the present invention by inserting an appropriate number and denomination of legal tender coins into a slot on the front of the power supply 38. However, this coin activated mechanism is not the only manner in which the operation of the invention can be controlled as other methods of operational control consisting of key and other similarly activated devices can easily be incorporated in the design of the operating systems of the present invention.

The mechanism that is employed to provide the rocking motion to the present invention further illustrated in FIGS. 3 and 4. The present invention is equipped with body base 44 which is pivotally attached by the use of the pivoting base connection 46 to the center of the lower surface of the ride body 16. The rocking motion is imparted to the present invention by the use of the two rocking rods 48 that are pivotally attached to the forward portion of the body base 44 by the use of the rod brackets 50. From this point of pivotal attachment, the rocking rods 48 extend upwards through the body floor and into the interior of the forward body cavity 36 where they are attached to the rocker assembly 53 just forward of the point of attachment for the drive motor 52.

The rocking motion of the ride body 16 is illustrated in these FIGS. by the forward end of the ride body 16 being lifted up and separated from the body base 44 resulting in the ride body 16 being oriented at a downward angle in relation to its most forward end relative to its most rearward. This position places the foot 24 located on the lower end of each of the gate frames 22 solidly on the floor upon which the invention is placed. From this rearwardly tilted position, the ride body 16 is pivoted until its forward end obtains a similar position to that of the previously described rearward end. This up and down motion of the ride body 16 is then repeated for a predetermined time period which provides the rocking motion that is pivotal to the operation of such amusement rides.

The method of construction and specific manner of operation of the electric drive motor 52 and rocker assembly 53 are further detailed in FIGS. 5, 6, and 7. The rocker assembly 53 is the component of the present invention which transfers the rotational force supplied by the drive motor 52 to the vertical displacement motion required to provide the rocking motion necessary for the operation of the invention. This transfer of power is began by the drive chain which transfers the rotational power from the drive motor 52 to the drive shaft 60. The drive shaft 60 is the central component of the rocker assembly 53 and has fixedly attached on either end a pair of rod cams 54 which are generally circular discs fixedly attached to either end of the drive shaft 60 at their center and having an outwardly and perpendicularly extending cam pins 56 fixedly attached to the outer edge of the rod cams 54 in relation to their rotational center and to the outside surface of the rod cams in relation to the body of the drive shaft 60 of the rocker assembly 53. This manner of construction means that the rotational force transferred to the drive shaft 60 from the drive motor 52 forces the cam pins 56 to travel in a circular path around the outside of the rod cams 54 which results in a vertical displacement of the cam pins 56 described by the outside diameter of the rod cams 54.

The cam pins 56 provide the point of rotational attachment at the cam attachments 64 for the upper ends of the rocking rods 48 which are in turn pivotally attached to the body base 44 after passing through body floor 62 by the use of the rod brackets 50. The illustrations of FIGS. 6 and 7 detail the operations of the drive motor 52 and rocker assembly 53. Specifically, these FIGS. detail the manner in which the rotation of the rod cams 54 and the relative positioning of the cam pins 56 due to this rotation operate to continually change the spacial relationship between the ride body 16 and the body base 44. This change is due to the fact that the cam pins 56 are connected to the body base 44 by the rocking rods 48. Therefore, as the rod cams 54 rotate the cam pins 56 to their lowest position relative to the body floor 62, the gap between the body floor 62 and the body base 44 widens causing the forward end of the present invention to rock upward. Conversely, when the rotation of the rod cam 54 move the cam pins 56 to their highest position relative to the body floor 62, the gap between the body floor 62 and body base 44 closes which causes the forward end of the invention to rock downward. Thus, the circular force provided by the drive motor 52 is converted to the vertical motion necessary to operate this type of rocking amusement ride by the use of the rocker assembly 53 and the cam pins 56.

The operation of the end gate/ramp 20 and its use of the gate spring 66 and gate switch 68 is further detailed in FIGS. 9 and 10 which illustrate the end gate/ramp 20 in its lowered position for use as an access ramp. The gate spring 66 is an apparatus that is used by the present invention to lessen the force necessary to raise the end gate/ramp from the lowered position to the upright and locked position. This feature is important to the operation of the present invention as it allows individuals with limited physical strength to operate it. Thus, the use of the gate spring 66 provides access to the use of the invention to a group of people who otherwise would be incapable of operating it, thereby furthering the spirit and scope of the invention as a whole.

The position of the end gate/ramp 20 is monitored by the gate switch 68 which is located within the base of one of the gate frames 22 in a manner which enables it to determine whether the end gate/ramp 20 is in the open or closed position. This is very important to the operation of the present invention as, for safety purposes, the rocking motion provided by the drive motor 52 cannot be activated if the end gate/ramp 20 is left in the open position. This ensures that an individual who is using the invention and who is bound to a wheelchair 12 cannot accidentally exit the rear of the ride, an occurrence that could easily result in an injury.

The body cavity 17 of the present invention can be configured in one of two different manners depending upon the physical characteristics of the intended user. For use with able-bodied individuals, the invention's moveable seat 70 is positioned in a rearward manner within the body cavity 17 with the front and rear seat wheels, 72 and 74, rolled back to the most rearward sections of the seat guide rails 42. This provides sufficient room between the front edge of the moveable seat 70 and the steering wheel 34 which allows able-bodied people to enter the body cavity 17 through the body access door 26 on the center side of the ride body 16.

For the wheelchair 12 bound individuals, the moveable seat 70 is capable of being moved forward into the forward body cavity 36 located just beneath and behind the steering wheel 34. The forward movement of the moveable seat 70 provides sufficient room within the body cavity 17 to allow for the positioning of a wheelchair 12 in front of the steering wheel 34, thereby, allowing a wheelchair 12 bound individual to derive enjoyment the from such rocking amusement rides that was previously limited to able-bodied people.

The manner in which the seat guide 42 rails are constructed and their method of operation are further detailed in FIGS. 13, 14, 15, and 16. The seat guide rails 42 are primarily made up of a rail body 90 which is an open top U-shaped channel that extends diagonally upward from its forward most point to its rearward most and which provides the track over which the front and rear seat wheels, 72 and 74, roll to properly position the moveable seat 70. Additionally, the front and rear sections of the rail body 90 are also fixed with the forward containment rail 76 and the rearward containment rail 78 which are both essentially caps that overhang the rail body 90. This configuration ensures that the front and rear seat wheels, 72 and 74, cannot leave the rail body 90 under any circumstances (whether the moveable seat 70 is in the rearward or forward position), providing an additional measure of safety to the maintenance and operation of the present invention.

The seat guide rails 42 also provide the point of attachment for the plurality of sensing and actuating devices that are important to the operation of the present invention. These devices include the wheel solenoid 86 which functions to hold the front seat wheels 72, and therefore the moveable seat 70, in an upright and rearward position in relation to the length of the rail body 90. This positioning is accomplished through the use solenoid plunger 88 which is a moveable extension of the wheel solenoid 86 that can be extended into the wheel channel of the rail body in a manner that impedes the movement of the front seat wheels 72. With this purpose in mind, the wheel solenoid 86 is positioned on the seat guide rails 42 in a manner that will allow the solenoid plunger 88 to lock the moveable seat 70 (through the blocking of the front seat wheel) in the proper position on the rail body 90 so that the present invention can be used by an able-bodied individual. An additional result of this positioning of the moveable seat is that in this rearward and locked position, the rear seat wheel 74 engages the rearward wheel switch 84 which is located at the most rearward end of the rail body 90. The rearward wheel switch 84 functions with other components of the present invention's electrical system to control the operations of the amusement ride which will be discussed in greater detail below.

The most forward end of the rail body 90 is equipped with a rail detent area 80 which is an area of the rail body 90 which slopes shapely downward in relation to the remainder of the rail body 90. The purpose of the rail detent area 80 is to hold the moveable seat 70 in the desired position when it is moved all the way forward within the invention for use with a wheelchair 12 bound individual. This operates by providing a depression into which the front seat wheel 72 drops when the moveable seat 70 is moved all the way forward on the rail body 90. Thus, in order to reposition the moveable seat 70, the front seat wheel 72 must be removed from the rail detent area 80 which requires a significant amount of force; certainly more than can be generated by the motion of the invention. Finally, the most forward end of the rail detent area 80 is also equipped with a forward wheel switch 82 which is designed to operate in conjunction with the remaining components of the present invention's electrical and operating systems.

The electrical and operating systems of the present invention are detailed in FIG. 17 which is a flow chart representing the manner in which the components of the system control the operation of the invention. The electrical system consists of two separate circuits that are operationally dependant on one another and which are both controlled through the power supply 38. The first of these individual circuits operates the drive motor 52 used to provide the rocking motion that is central to the theme of the amusement ride. The drive motor 52 is connected directly to the power supply 38 through a feed wire 92 and the activation of the drive motor 52 is dependant on the proper configuration of the second circuit of the invention.

The second circuit consists of the three positional switches, the gate switch 68, the forward wheel switch 82, and the rearward wheel switch 84, and the wheel solenoid 86 which are also connected to the power supply through a series of feed wires feeds 92 and the solenoid control switch 40. The primary function of the solenoid control switch 40 is to release the solenoid plunger 88 of the wheel solenoid 86 which allows the moveable seat 70 to move forward and out of the way of a wheelchair 12. The remaining components of this circuit function to monitor the position of the primary components of the invention. The important thing to note in this regard is that the interconnection of the two systems operates to ensure that the drive motor 52 cannot be engaged by the power supply 38 unless the monitoring switches confirm that their related component is in the proper position for the safe operation of the invention. That is to say, if either the forward or rearward wheel switches, 72 and 74, do not register the presence of the moveable seat 70, the power supply 38 will not activate the drive motor 52. Likewise, if the gate switch 68 indicates that the end gate/ramp 20 is not properly closed, the drive motor 52 will not operate. This interconnected design enhances the overall safety of the present invention as it ensures that it cannot be operated if any of the safety features are not properly configured.

An additional safety feature of the present invention is illustrated in FIGS. 18 and 19 which detail the use of a plurality of end gate shocks 94. The end gate shocks 94 extend from their point of pivotal attachment to the end gate/ramp 20 at the upper shock mount 96 to their pivotal point of attachment to the interior wall of the gate frames 22 at the lower shock mount 98. The purpose of the end gate shocks 94 is to control the motion of the end gate/ramp 20 during the opening process. This is necessary because without the use of the end gate shocks 94, the end gate/ramp 20 can drop down too quickly and the force of this opening process could injure an individual that is in the path of the opening end gate/ramp 20. The end gate shocks 94 control this by forcing the end gate/ramp 20 to open in a slow and controlled manner which eliminates any risks involved in the opening process to both bystanders and users of the present invention.

A further safety feature of the present invention is illustrated in FIGS. 20 and 21 which detail the use of a safety skirt 100 which spans the gap 101 between the lower edge of the ride body 16 and the body base 44. The use of this safety device is made necessary by the rocking motion of the invention as it creates an opening and closing gap 101 between the ride body 16 and the body base 44. Consequently, if this gap were left open a user or bystander could sustain an injury by inadvertently placing a foot, hand, or other appendage into the closing gap 101 and having it pinched and compressed by the rocking motion of the present invention. The use of the safety skirt 100 eliminates this hazard as it closes off the gap 101 between the ride body 16 and the body base 44.

The safety skirt 100 is made up of a flexible yet extremely durable fabric-like material that will allow the relationship between the ride body 16 and the body base 44 to continually change due to the rocking motion of the invention while making it impossible for anything to be placed within the gap 101. The attachment of the safety skirt 100 to the invention is accomplished by the use of a plurality of attachment screws 102 which, on the lower end of the safety skirt 100, attach it to the outer edge of the body base 44, and on the upper end attach it to the inner surface of the lowest edge of the ride body 16. Additionally, this attachment is performed around the entirety of the perimeter of the invention ensuring that there are no open areas which would allow for the passage of a foreign object into the gap 101. Thus, the use of the safety skirt 100 in conjunction with the present invention enhances its safe operation for not only the primary user, but also for those who are close to the invention during its operation. The fact that wheelchair 12 bound individuals are normally accompanied by adults and other similar individuals, makes the safety skirt 100 a vital component for the safe operation of the present invention.

The manner in which a start button 108 is used with the present invention is detailed in FIG. 22. As previously stated, the primary control of the invention is a function of the power supply 38 which is located on the right side of the dashboard 104 outside of the steering wheel 34. However, the power supply 38 only activates the invention after the user performs the necessary initiating process (inserting the proper number of coins or turning the key) and then depresses the start button 108. This ensures that the rocking motion of the invention is not began until the user is properly positioned within the ride body 16. Additionally, the dashboard 104 also contains a plurality of accessory buttons 106 which control the operation of the entertainment accessories such as the emergency light, siren, and bells. These features enhance the entertainment value of the invention to its potential users as they provide an additional measure of reality to the ride.

A still further safety device that is employed in the normal use of the present invention is illustrated in FIGS. 23 and 24 which detail the configuration of the inner side panels 110. The inner side panels 110 function to isolate the moving parts of the moveable seat 70 component of the invention from the user within the interior of the invention. This isolation is accomplished by the inclusion of a axle slot 116 that is diagonally oriented in the face of the inner side panel 110 in a position that coincides with the upper surface of the seat guide rails 42. The openings of the axle slots 116 is enclosed by the use of two oppositely oriented axle seals 114 which meet roughly along the center line of the axle slots 116. The axle seals 114 are made of a material that is highly flexible and that will readily return to its original configuration when a distortion force has been applied and subsequently removed. This characteristic not only allows the wheel axles 112 to pass from their point of attachment at the front and rear seat wheels, 72 and 74, through the inner side panels 110, but also makes it possible for the moveable seat 70 to move up and down the seat guide rails 42 without losing this seal. Additionally, the seal not only isolates the user from these moving parts, but also keeps dirt and other debris from interfering with the efficient operations of the moveable seat 70 component of the invention.

Finally, an alternative embodiment of the seat guide rail 42 components of the present invention which is illustrated in FIGS. 25 and 26. This embodiment of the invention moves the wheel solenoid 86 from its position on the rail body 90 which places the protruding solenoid plunger 88 in front of the front seat wheel 72 rearward to a point at which it protrudes in front of the rearward position of the rear seat wheel 74. Despite this change of position, the interaction between the wheel solenoid 86 and the rear seat wheels 74 is exactly as described in the previous embodiment for the interaction between the wheel solenoid 86 and the front seat wheel 72.

The changing of the wheel solenoid's 86 position allows the invention to operate without need for the installation of the forward and rearward wheel switches, 82 and 84. The difference in the ride's operation is simply that the depression of the solenoid control switch 40 retracts the solenoid plunger 88 and allows the rear seat wheels 74 to move forward along the rail body 90. However, unlike the previous embodiment, the release of the solenoid control switch 40 allows the solenoid plunger 88 to return immediately to its protruding position after the rear seat wheels 74 has passed. This allows the forward and rearward wheel switches, 82 and 84, to be eliminated as the solenoid plunger's 88 default position is extended and the moveable seat 70 can only be either held in its rearward position by the solenoid plunger 88 or all the way forward at the bottom of the diagonally oriented rail body 90. Thus, the functions of the forward and rearward wheel switches, 82 and 84, of monitoring the position of the moveable seat 70 is no longer necessary as the solenoid plunger 88 is always extended unless the solenoid control switch 40 is depressed which means that the moveable seat 70 can only be in one of two possible positions during all phases of the operation of the present invention.

Although the present invention has been described in considerable detail with reference to certain preferred versions thereof, other versions are possible. Therefore, the spirit and scope of the appended claims should not be limited to the description of the preferred versions contained herein.

What is claimed is:

1. An amusement ride comprising a:

a stationary base;

a ride body defining a ride body cavity, said ride body connected to said stationary base such that said ride body is movable relative to said stationary base;

a track system mounted within said ride body; and a seat slidably moveable on said track system between a first back position wherein the seat is back in said body cavity so as to be useable by a seated rider and a forward position wherein said seat is forward in said body cavity to provide space in said body cavity for a wheelchair.

2. An amusement ride as in claim 1 further comprising a gate pivotally mounted to said ride body, said gate being movable between a first lowered ramp position and a second upward position enclosing said body cavity.

3. An amusement ride as in claim 2 further comprising a solenoid system mounted to said track so as to control the movement of said seat.

4. An amusement ride as in claim 3 wherein said seat further comprises a plurality of wheels for moving along said track system.

5. An amusement ride as in claim 4 wherein said ride body is pivotally mounted to said stationary base such that said ride body rocks back forth relative to said stationary base.

6. An amusement ride as in claim 5 further comprising a coin operated mechanism for controlling the movement of said ride body.

7. An amusement ride as in claim 6 further comprising a series of switches for controlling the movement of said ride body and assuring said gate and said seat are properly positioned for operation.

8. An amusement ride as in claim 7 further comprising a flexible shield attached to said stationary base and said ride body.

9. An amusement ride as in claim 8 further comprising a flexible shield attached to said stationary base and said ride body.

10. An amusement ride comprising a:

a stationary base;

a ride body defining a ride body cavity, said ride body connected to said stationary base such that said ride body is movable relative to said stationary base;

a track system mounted within said ride body; and a seat having plurality of wheels slidably moveable on said track system within said body cavity such that said seat is useable by a seated rider or moved so as to provide space in said body cavity for a wheelchair.

11. An amusement ride as in claim 10 further comprising a gate pivotally mounted to said ride body, said gate being movable between a first lowered ramp position so to allow a wheelchair access to said body cavity and a second upward position enclosing said body cavity.

12. An amusement ride as in claim 11 further comprising a solenoid system mounted to said track so as to control the movement of said seat.

13. An amusement ride as in claim 12 wherein said ride body is pivotally mounted to said stationary base such that said ride body rocks back forth relative to said stationary base.

14. An amusement ride as in claim 13 further comprising a coin operated mechanism for controlling the movement of said ride body.

15. An amusement ride as in claim 14 further comprising a series of switches for controlling the movement of said ride body and assuring said gate and said seat are properly positioned for operation.

16. An amusement ride comprising a:

a stationary base;

a ride body defining a ride body cavity, said ride body pivotally connected to said stationary base such that said ride body is movable back and forth relative to said stationary base;

a motor and cam system connected to said stationary base and said ride body so as to move said ride body relative to said base;

a seat moveably connected to said ride body so as move within said body cavity such that said seat is useable by a seated rider or moved so as to provide space in said body cavity for a wheelchair; and a gate pivotally mounted to said ride body said gate being movable between a first lowered ramp position so to allow a wheelchair access to said body cavity and a second upward position enclosing said body cavity.

17. An amusement ride as in claim 16 further comprising a solenoid system mounted to said track so as to control the movement of said seat.

18. An amusement ride as in claim 17 further comprising a coin operated mechanism for controlling the movement of said ride body.

19. An amusement ride as in claim 18 further comprising a series of switches for controlling the movement of said ride body and assuring said gate and said seat are properly positioned for operation.

* * * * *